US005622306A

United States Patent [19]

Grigsby, Sr.

[11] Patent Number: 5,622,306

[45] Date of Patent: Apr. 22, 1997

[54] TUBULAR CORRUGATED PAPERBOARD SHIPPING CONTAINER WITH A PAIR OF ATTACHING STRIPS

[75] Inventor: John M. Grigsby, Sr., Marietta, Ga.

[73] Assignee: North American Container Corp., Mabelton, Ga.

[21] Appl. No.: 555,385

[22] Filed: Nov. 9, 1995

[51] Int. Cl.[6] ..... B65D 8/04

[52] U.S. Cl. ..... 229/23 C; 217/36; 217/65; 206/386

[58] Field of Search ..... 229/23 C; 217/36, 217/43 A, 65; 206/335, 386, 599, 600; 108/901

[56] References Cited

U.S. PATENT DOCUMENTS

| | | | |
|---|---|---|---|
| Re. 34,557 | 3/1994 | Grigsby | 229/23 C |
| 2,276,495 | 3/1942 | Kenfield | 229/23 C |
| 2,316,854 | 4/1943 | George et al. | 217/13 |
| 2,488,692 | 11/1949 | Talbot | 229/23 C |
| 2,596,320 | 5/1952 | Witte | 217/12 |
| 2,812,096 | 11/1957 | Muller | 217/65 |
| 2,887,241 | 5/1959 | MacKenzie | 229/23 C |
| 2,965,276 | 12/1960 | Foster | 229/23 C |
| 3,045,889 | 7/1962 | Whiton | 229/23 C |
| 3,136,472 | 6/1964 | Waller et al. | 229/23 C |
| 4,166,569 | 9/1979 | Begnaud et al. | 206/386 |
| 4,171,741 | 10/1979 | Fish | 206/335 |
| 4,832,256 | 5/1989 | Grigsby | 229/23 C |
| 5,096,112 | 3/1992 | Grigsby | 229/23 C |
| 5,275,279 | 1/1994 | Grigsby | 229/23 C |

FOREIGN PATENT DOCUMENTS

| | | |
|---|---|---|
| 1265313 | 5/1961 | France . |

*Primary Examiner*—Gary E. Elkins
*Attorney, Agent, or Firm*—Kennedy & Kennedy

[57] ABSTRACT

A tubular corrugated paperboard shipping container having a rigid base frame, a cleat-reinforced tubular corrugated paperboard body attached thereto, and a top frame. The corrugated paperboard body includes a pair of spaced-apart attaching strips fixed on opposing side wall panels of the body. One of the pair of attaching strips on each panel is disposed in alignment with a member of the base frame. The other one of the pair of attaching strips is positioned on the panel in alignment with the top frame. Staples driven through the paperboard wall and the attaching strips secure the paperboard container to the base frame and to the top frame to ensure against component separation, thereby providing a cleated container with improved structural rigidity. A plastic sheet in the top frame prevents dust and dirt from entry into the container.

24 Claims, 3 Drawing Sheets

TUBULAR CORRUGATED PAPERBOARD SHIPPING CONTAINER WITH A PAIR OF ATTACHING STRIPS

TECHNICAL FIELD

The present invention relates generally to cleat-reinforced corrugated containers and, more particularly, to a cleat-reinforced corrugated paperboard shipping container for packing, shipping, and storing heavy equipment.

BACKGROUND OF THE INVENTION

Packaging heavy, bulky machinery such as lawn and garden tractors, lawn mowers, snowmobiles, boat motors, engines, air compressors, air conditioners and the like, presents many unique considerations. Because such machinery is by its nature difficult to handle and store, conventional double-wall or triple-wall laminated corrugated paperboard containers have long been recognized as being unsuitable for packaging heavy equipment. As a result, cleat-reinforced containers with mating rigid base and top frames have been developed. Generally, the cleats, the base frames, and the top frames are made of wood. These shipping containers are also often referred to as wood-cleated boxes.

The conventional wood-cleated box consists of a wood-reinforced corrugated paperboard body, a wooden top frame, and a wooden base frame. Generally, the interior walls of the corrugated paperboard body are provided with wood reinforcement cleats that are vertically aligned in order to provide stacking strength for the container. The corrugated paperboard body gives the container definition and maintains the position of the wood reinforcement cleats. The base frame often referred to as a skid or pallet, supports the container and the product packed therein. The top frame closes off the container and provides a surface upon which another container may be stacked. The top frame, the vertical reinforcement cleats in the body, and the base frame cooperatively provide the container with top load strength, such that the containers may be shipped and stored in multi-unit stacks.

Conventional packaging of heavy equipment in typical wood-cleated boxes call for the product to be packed by first being fastened to the base frame. The corrugated paperboard body is then placed over the product and over the base frame. The corrugated paperboard body is stapled to the base frame in a conventional manner by a compressed-air driven staple gun. The top frame is inserted into the upper portion of the corrugated paperboard body and supported by the reinforcement cleats on the corrugated paperboard body. The top flaps of the box are then folded and glued or stapled closed. Steel or plastic banding may then be provided to gird the completed package.

While these conventional wood-cleated containers have proven adequately effective for packaging heavy equipment, several problems existed. As described in U.S. Pat. No. Reissue. 34,557, handling of such wood-cleated boxes with clamp trucks led to separation of the base frame from the corrugated paperboard body. Because the packaged product is often extremely heavy, a tremendous downward force is exerted against the base frame with respect to the corrugated paperboard body. The staples that secure the base frame to the corrugated paperboard body often worked through the paperboard and were pulled loose. As a result, the base frame and the packaged product secured thereto fell from the corrugated paperboard body, causing irreparable damage to the container, significant damage to the product, and potential harm to bystanders. U.S. Pat. No. Reissue. 34,557 addressed the problem of the base and body separation to assure container integrity during packing, shipping, and storage. Attaching strips on a lowermost portion of the corrugated body aligned with the base frame. The corrugated paperboard body was then secured to the base frame by driving staples through the body and the attaching strips into members of the base frame. This provided a rigid contact connection between the base frame and the corrugated paperboard body, which reduced the potential for component separation.

While this improvement has resolved this problem, such cleated-containers experience other unresolved problems. During shipment, twisting, lateral forces are exerted on the cleat-reinforced corrugated paperboard containers. When three or four containers are stacked one on top of the other in a truck, rail car, or the like, the jostling action resulting from typical transport often causes the top flaps on the upper container to prematurely loosen and open. Often this is caused by a twist or torquing motion on the cleat-frame of the container. Such a torque or twist causes the top frame to push through the top flaps, thus opening the container and exposing the product inside to possible contamination or damage.

Another problem is the price of corrugated paperboard. The top flaps often represent 10% to 30% of the cost of the corrugated paperboard in the body. While the top flaps provide a closed covering for preventing dust, dirt, or other contamination from contacting the product in the container, other wrapping mechanisms may suitably protect the product at a lower cost. For instance, the product may be enclosed in a plastic sheet or bag. The top flap is no longer needed to function as a protective covering, and thus reflects a cost with reduced benefit.

Further, the top flaps hide the members comprising the top frame. The top flaps thus appear to provide a support surface for other containers. If a container of the same size is placed on the top frame, the loading is distributed from the top frame directly through the reinforcement cleats to the base frame. However, if a smaller but heavier container is placed on the top flaps, such as in less-than-full truckload shipments, the smaller, heavier container may tear the top flaps and fall through into the container, thereby damaging both the falling container and the product held in the cleated container.

It is thus seen that a need exists for an improved cleat-reinforced corrugated paperboard shipping container which protects articles within the container while increasing the integrity of the container. It is to the provision of such that the present invention is primarily directed.

SUMMARY OF THE INVENTION

The present invention in a preferred apparatus provides a cleat-reinforced tubular corrugated paperboard shipping container having a base frame suitable for supporting an article to be packed. The base frame includes at least a pair of spaced-apart elongate members that extend substantially a length of said base frame. A tubular corrugated paperboard body defines inner wall surfaces and corresponding outer wall surfaces. The corrugated paperboard body comprises a wall-forming blank of corrugated paperboard scored to provide a series of main panels foldably joined together at a plurality of corners and dimensioned for mating engagement with the base frame such that at least one of the main panels extends the length of said base frame. A plurality of reinforcement cleats are fixedly secured to the inner wall surfaces and aligned substantially parallel with the scores, with at least one of the cleats adjacent each one of the corners. A top frame is dimensioned for receipt by the corrugated paperboard body. The container includes a pair of spaced-apart, parallel attaching strips fixedly secured to each of at least two panels of the corrugated paperboard body. One of each pair of attaching strips is positioned on the respective panel for alignment with one of the pair of members in the base frame. The other one of each pair of attaching strips is positioned on the respective panel for alignment with the top frame. Staples insert through both the corrugated paperboard body and the respective attaching strip into the members and the top frame to secure the body to the base frame and the top frame. The top frame includes a plastic sheet as a barrier to entry of dust and dirt into the container. Attachment of the corrugated paperboard body to the base frame and the top frame provides a connection that ensures against component separation during handling of the packed container.

In an alternate embodiment, the present invention provides a wood cleat-reinforced tubular corrugated paperboard shipping container comprising a tubular corrugated paperboard body made from a blank of corrugated paperboard scored to provide a first, a second, a third, and a fourth main panel. The panels have interior container walls and exterior container walls. The panels are foldably joined together at corners and each panel defines an upper portion and a lower portion. A pair of vertical supports are fixedly secured to the interior wall of the first main panel and the third main panel of the corrugated paperboard body. The vertical supports each have a top portion and a notched lower portion which is preferably one-half the width of the remaining portion of the vertical support. A plurality of attaching strips are secured about a lower portion of said corrugated paperboard body, with at least one of the attaching strips secured to each of the main panels in substantial alignment with the notched lower portion of the vertical supports. The attaching strips are preferably of a width substantially equal to that of the vertical supports at the notched portions. The corrugated paperboard body matingly connects to a wooden base member in alignment with the attaching strips. A top frame is received by the tubular body for mating engagement with the top portions of the vertical supports. Attachment of the attaching strips to the base member and the top frame provides a rigid connection ensuring against separation thereof.

In another embodiment, the present invention provides a wood-reinforced tubular corrugated paperboard shipping container having a base frame for supporting an article to be packed. The base frame includes at least two wood strips that extend substantially the length of the base frame. A tubular corrugated paperboard body defines inner container walls and corresponding outer container walls and is configured for engagement to the base frame. The paperboard body comprises a wall-forming blank of paperboard scored to provide a series of panels foldably joined together at a plurality of corners. A plurality of substantially vertical, wooden supports are fixedly secured to the inner container walls adjacent the corners and sufficiently distanced therefrom to permit collapse of said paperboard body. A top frame is received by the tubular body and is supportingly contacted with upper ends of the supports. At least two pairs of spaced-apart attaching strips are fixedly secured to a lowermost portion and an uppermost portion of said container walls. The attaching strips extend substantially a length of said container walls. Staples secure the attaching strips to the wood strips to the top frame, whereby the tubular corrugated paperboard body is secured to the base frame and the top frame to assure against component separation.

Generally described, the present invention provides a reinforced tubular corrugated paperboard shipping container comprising a base frame for supporting an article to be packed. A corrugated paperboard body assembles from a wall-forming blank of paperboard scored to provide a series of panels foldably joined together at a plurality of corners and configured for engagement to the base frame. A plurality of substantially vertical supports are fixedly secured to the container walls adjacent the corners for reinforcing the paperboard body. The container has at least two pairs of attaching strips. Each pair is fixedly secured to opposing ones of the panels. Each attaching strip in each pair is spaced-apart, with one of each said pair positioned for alignment with one of the elongate members and the other one of each pair of attaching strips positioned for alignment with the top frame. The attaching strips are preferably wood, dense hardwood, or fiberboard. A plurality of staples insert through the panels and the attaching strips into the elongate members and the top frame to secure the body to the base frame and the top frame. Engagement of the reinforced corrugated paperboard body to the base frame and the top frame ensures against component separation.

Objects, features and advantages of the present invention will become apparent from a reading of the following detailed description of the invention and the claims in view of the appended drawings.

DETAILED DESCRIPTION

Figure 1:
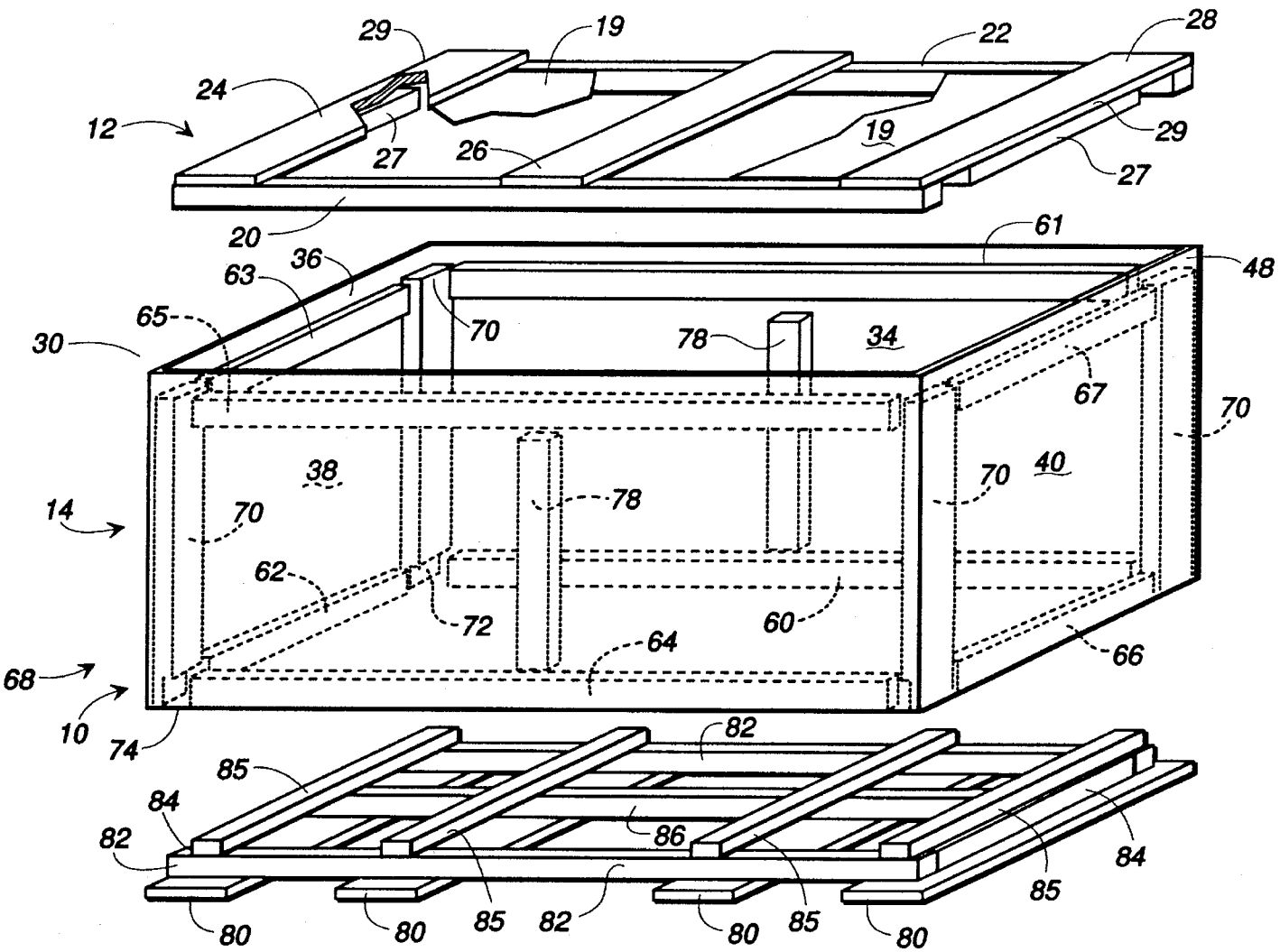
FIG. 1 is a perspective exploded view of a preferred embodiment of tubular corrugated paperboard container constructed in accordance with the present invention, with certain portions of the embodiment shown in phantom.

Referring now in more detail to the drawings, in which like numerals indicate like parts throughout the several views, FIG. 1 shows a preferred embodiment of a reinforced tubular corrugated paperboard shipping container 10 with attaching strips according to the present invention. The container 10 includes a top frame 12 illustrated exploded away above a tubular corrugated paperboard body 14 and a bottom frame 16 exploded away therebelow. The corrugated paperboard body 14 is defined by a series of panels and at least two panels each include spaced-apart pairs of attaching strips discussed below, for cooperatively securing the body 14 to the top frame 12 and to the base frame 16. Each of these component parts of the present invention are described in detail below.

Figure 4:
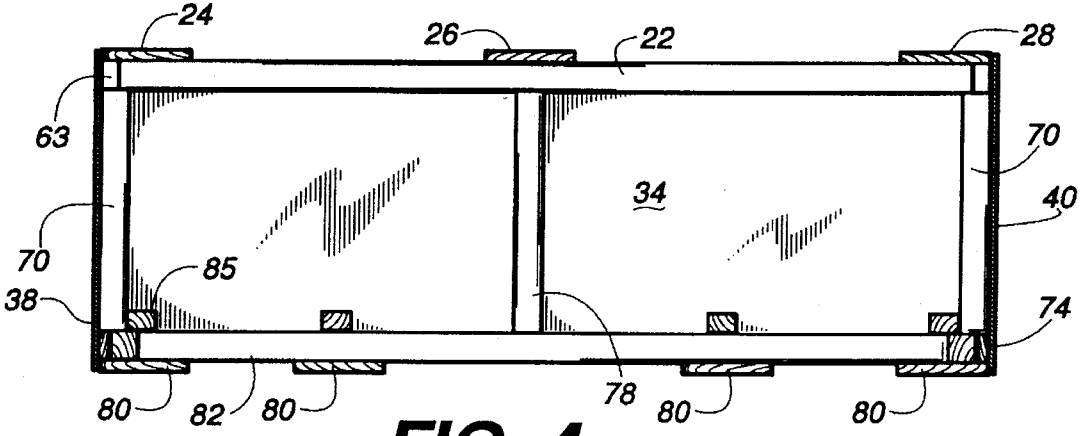
FIG. 4 is a section view of the embodiment shown in FIG. 1.

The top frame 12 consists of two wood pieces 20 and 22 that run lengthwise of the container 10. Three wood pieces 24, 26, and 28 are secured to the top of the two lengthwise pieces 20 and 22. The members 20 and 22 are spaced inwardly of the end faces 23 of the pieces 24, 26, and 28, for a purpose discussed below. Transverse members 27 connect to a lower surface of the respective end pieces 24 and 28. Each member 27 is spaced inwardly of an edge 29, for a purpose discussed below. In the illustrated embodiment, a sheet 19 of plastic film extends the length and width of the top frame 16. The edge portions of the sheet 19 are disposed between the pieces 20 and 22, the cross members 24, 26, and 28, and the transverse members 27. The sheet 19 is shown in cut-away view in FIG. 1 to facilitate illustrating features of the top frame 12. The elements 20, 22, 24, 26, 27, and 28 may be secured in this arrangement by nails, staples, or other suitable connector. As best shown in FIGS. 1 and 4, the top frame 12 is dimensioned for being received in an uppermost portion generally designated 30 of the corrugated paperboard body 14.

Figure 2:
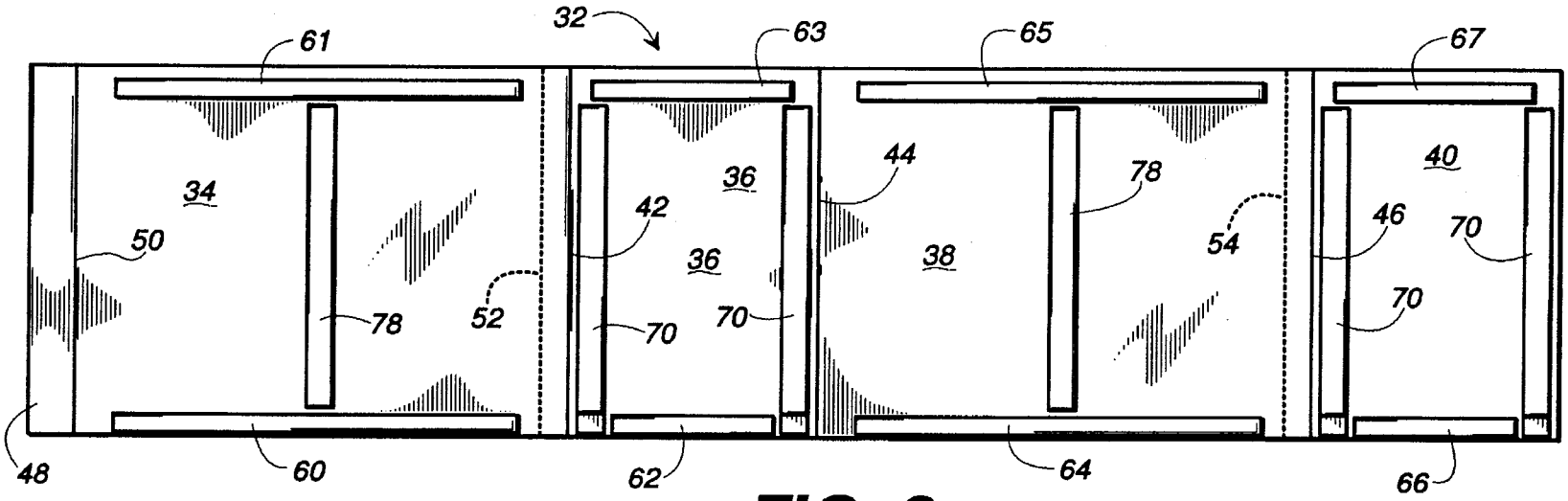
FIG. 2 is a top plan view of a corrugated paperboard blank for forming the tubular body portion of the container shown in FIG. 1.

With reference to FIGS. 1 and 2, the corrugated paperboard body 14 of the present invention is formed from a blank 32 of corrugated paperboard material. The blank 32 includes four main panels 34, 36, 38, and 40 foldably connected along three score lines 42, 44, and 46. The four main panels 34, 36, 38, and 40 form the four walls of the container 10 as shown in FIG. 1. A manufacturer's joint 48 is foldably connected to the main panel before along a score line 50. The function of the joint 48 is well-known to those skilled in the art and is otherwise outside the scope of the present invention. Two additional folding scores 52 and 54 are provided on the blank 32. In the illustrated embodiment, the additional folding score 52 is on the panel 34 and the additional folding score 54 is on the panel 38. The function of these additional scores is described in detail below.

Each main panel 34, 36, 38, and 40 is provided with a pair of lower and upper attaching strips 60, 61; 62, 63; 64, 65; and 66, 67; respectively. The attaching strips 60, 62, 64, and 66 are positioned at a lowermost portion 68 of the respective panel 34, 36, 38, and 40. The attaching strips 61, 63, 64, 65, and 67 are positioned at an uppermost portion 30 of each panel. The attaching strips 60–67 are preferably made of a dense material and each extends substantially the length of their respective panels 34, 36, 38, and 40. In an alternate embodiment, several lengths of an elongate dense material are positioned spaced-apart and in linear alignment on the panel as the attaching strip. In a preferred embodiment, the attaching strips are made of a dense hardwood. However, the attaching strips may be formed of fiberboard or a like material suitable for rigidly holding staples or other fasteners. The attaching strips 61 and 65 extend up to but do not cross the fold lines 52 and 54, respectively. The attaching strips 60–67 are fixedly secured preferably by both staples and adhesive to bond the attaching strips to the main panels of the container 10.

The main panels 36 and 40 of the blank 32 are each provided with corner reinforcement cleats 70. The cleats 70 are disposed with longitudinal axes substantially parallel to the score lines 42, 44, and 46. The reinforcement cleats 70 extend substantially the height of the respective main panels 36 and 40 and are preferably made of a material having high compressive strength. The cleats 70 may be made from a dense hardwood or from assembled structural members comprising layers of a relatively low density material capped by layers of a relatively high density material to form a column having high compressive strength.

Figure 3:
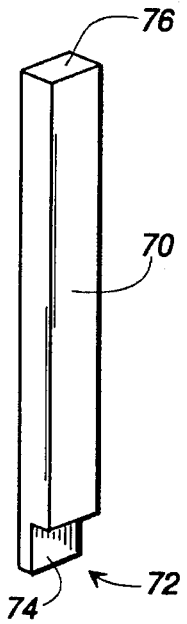
FIG. 3 is a prospective view of a reinforcement cleat of the embodiment shown in FIG. 1.

In the illustrated embodiment, the lowermost edge of the reinforcement cleats 70 sit near the very bottom of their respective main panels 36 and 40. As best illustrated in FIG. 3, the bottom portion of each reinforcement cleat 70 is notched; the notch being generally indicated at 72. The cut-away notch 72 provides an indent having a recessed wall 74. The uppermost portion 76 of each reinforcement cleat 70 is preferably perpendicular to the longitudinal faces of the cleat. In an alternate embodiment (not illustrated) the uppermost portion 76 of each reinforcement cleat 70 is beveled at about 24° such that the outer portion of the reinforcement cleat is of greater height than the innermost portion of the cleat. For this embodiment, the lengthwise elements 20 and 22 of the top frame 12 are each formed with notches in the lower surfaces at the longitudinal ends. The notches facilitate mating receipt of the top frame 12 onto the beveled upper ends of reinforcement cleats 70.

In another alternate embodiment, the blank 32 for the body 14 has only two pairs of the attaching strips on two opposing panels. Thus, the attaching strips 62, 63 and 66, 67 are not used. In this embodiment, the cleats 70 may not include the notched portion 72. However, the notched portion 72 facilitates forming a joint between the cleat 70 and the end of the base runner 82.

In the illustrated embodiment, the main panels 34 and 38 are each provided with a reinforcing member 78 disposed medial the respective longitudinal ends of the panels. The reinforcing members 78 are preferably made of the same material as the cleats 70 and extend substantially the height of their respective main panels 34 and 36. However, as opposed to the cleats 70, the center reinforcements 78 extend no lower than the attaching strips 60 and 64 and no higher than the attaching strips 61 and 65. In the alternate embodiment in which the cleats 70 have beveled upper ends 76, the center reinforcement 78 extend no higher than the innermost edge of the top surface of such beveled cleats.

With reference to FIG. 1, the base frame 16 of the container 10 in the illustrated embodiment consists of four floorboards 80 that extend the width of the base frame 16. A pair of elongate length members 82 and a pair of elongate width members 84 are secured to the floorboards 80. The members 82 and 84 form a rectangular base member collectively referred to as the base crown. The members 82 and 84 are preferably made of a dense hardwood and may be fastened or otherwise secured to the floorboards 80 by nails, wood screws, glue, or other suitable means. The base frame 16 further consists of a center reinforcing strip 86 that extends between the members 82 to give stability to the base frame. It will be noted that the members 82 and 84 are set-off from the corner of the floorboards **80*a* and 80*b* for a purpose discussed below. The base frame 16 supports the article packaged within the container 10. Various members are included on the base frame 16 for supporting the particular article to be in the container 10. In the illustrated embodiment, the base 16 is designed to support a conventional garden or yard tractor. A plurality of cross-members 85 are spaced-apart and rigidly attached to the base crown to define wells 87 for receiving wheels of a tractor. An alternate embodiment (not illustrated) interlocks the base frame 16 with the corrugated paperboard body by providing overhang portions on the cross-members 85. The overhand portion of the cross-member and the side of the member 82 define a recess which receives the effective one of the attaching strips 60 or 64** attached to the lowermost portion of the wall of the container. U.S. Pat. No. 5,096,112 discloses such an interlocking base frame and paperboard container with attaching strips.

Figure 5A:
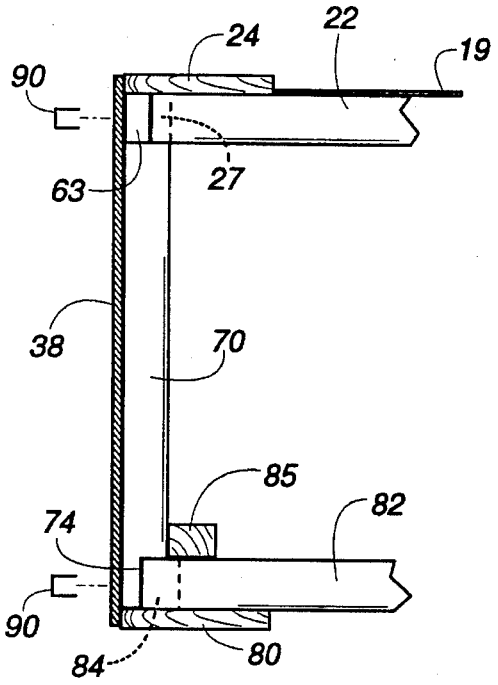
FIGS. 5*a* and 5*b* are partial views of the embodiment shown in FIG. 4, with a portion cut away to show the reinforcement cleat supporting the top frame.
Figure 5B:
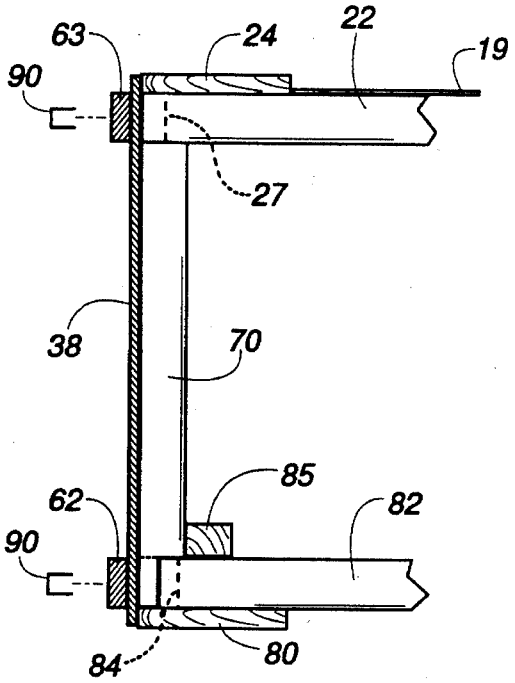

In the practice of the present invention, the blank 32 of corrugated paperboard is laid flat as shown in FIG. 2. The attaching strips 60, 61; 62, 63; 64, 65; and 66, 67 are fully glued and stapled to the inner surface of the main panels 34, 36, 38, and 40, respectively. In an alternate embodiment, the attaching strips are glued and stapled to the outer surface of the respective panels. The preferred staples are ½" to 1" crown, having leg length equal to approximately the thickness of the attaching strips 60–67 plus the thickness of the corrugated paperboard blank 32. It is furthermore preferred that the staples be spaced apart a distance of approximately four inches and angled at 45° to achieve maximum contact of the corrugated paperboard panels 34, 36, 38, and 40 to their respective attaching strips 61–67. In an embodiment using solid fiber attaching strips instead of wood attaching strips, it is preferred for the manufacturer's staples to be driven through the attaching strip and the box wall and be mechanically clinched behind the box wall. Solid fiber attaching strips are preferably used when the attaching strips are fixed on the outside surfaces of the wall panels as illustrated in FIG. 5*b* and wood strips are preferably used on the inside surface as illustrated in FIG. 5*a*. With the attaching strips 63, 67 on the outside, the members 27 are disposed flush with the edge 29. The corner reinforcement cleats 70 are attached in a similar manner to their respective main panels 36 and 40.

The notch 72 in each reinforcement cleat 70 aligns with its respective attaching strip 62 and 66 on the main panels 36 and 40, respectively. Additionally, the center reinforcements 78 are glued and stapled to their respective main panels 34 and 38. The blank 32 is then folded on the scores 42, 44, and 46 to form a tubular body 10. The manufacturer's joint 48 folds on the score 50 and overlaps an edge portion of the panel 40. The manufacturer's joint 48 is preferably glued to the edge portion of the panel 40 to form the tubular body 14. The formed corrugated paperboard body 14 may then be knocked down into a flat condition for shipment. The additional scores 52 and 54 are provided in diagonally opposite corners of the body 14. These scores 52 and 54 are of a sufficient distance from the main panel scores 42 and 46, respectively, to allow the body 14 to fold around the corner reinforcements 70.

The article to be packaged is positioned on the base frame 16 and secured thereto, such as with straps or bolts. The formed corrugated paperboard body 14 is then opened to a squared-out position and placed over the base frame 16. As best shown in FIGS. 1 and 4, the notches 72 in the bottom portions of the corner reinforcement cleats 70 are positioned such that the notched surfaces 74 sit flush against the base crown and in particular against the elongate members 82 and 84. Similarly, the attaching strips 60, 62, 64, and 66 sit flush against the elongate members 82 and 84 of the base crown, respectively. With reference to FIG. 5*a*, it will be appreciated that the thickness of the attaching strips, when disposed on the inside surface of the container walls, must not be greater than half the thickness of the vertical reinforcement cleats 70. The outermost portion of the attaching strips 60, 62, 64, and 66 are to be in alignment with the face of the notched surface 74 in the reinforcement cleat 70. When a corrugated paperboard body 14 is thus fit about the crown of the base 16 formed by the strips 82 and 84, the strips 82 and 84 may be joined with staples 90 or the like to the attaching strips 60, 62, 64, and 66 and to the notched portions 72 of the vertical corner reinforcement cleats 70.

The top frame 12 fits inside the upper dimensions of the corrugated paperboard body 14 supported by the cleats 70 and the cleat 78. The lower surfaces of the pieces 20 contact and rest on the upper ends of the cleats 78 and 70. The overlapping ends 23 of the pieces 24, 26, and 28 contact the upper surfaces of the pieces 20. The side faces of the pieces 20 and 27 abut against the attaching strips 61, 63, 65, and 67. Staples are then driven through the walls of the corrugated paperboard body 14 and the attaching strips 61, 63, 65, and 67 into the respective members 22, 27, 20, and 27 of the top frame 12. The staples 90 extend through the corrugated paperboard and the attaching strips 61, 63, 65, and 67 in order to secure the top frame 12 to the corrugated paperboard container 14. The cross pieces 24, 26, and 28 are appropriately positioned in order to avoid interference with any heavy packaged machinery within the container 10 while protecting same from damaging contact. The plastic sheet 19 provides a barrier which prevents dust, dirt, or other contamination from contacting the article held in the container 10. In an alternate embodiment, the notches in the lower surfaces of the members in the top frame 12 matingly join the beveled surfaces at the top of the corner cleats 70. This arrangement serves to lock the top frame into the corner vertical reinforcement cleats 70.

The foregoing has disclosed an improved cleat-reinforced corrugated paperboard container for packing, shipping, and storing heavy articles. It should be understood that the above described embodiments merely illustrate principles of the invention in preferred forms. Many modifications, additions, and deletions may, of course, be made thereto without departure from the spirit and scope of the invention as set forth in the following claims.

What is claimed is:

1. A cleat-reinforced tubular corrugated paperboard shipping container, comprising:

a base frame suitable for supporting an article to be packed, said base frame including at least a pair of spaced-apart elongate members that extend substantially a length of said base frame;

a tubular corrugated paperboard body defining inner wall surfaces and corresponding outer wall surfaces, said corrugated paperboard body comprising a wall forming blank of paperboard scored to provide a series of main panels foldably joined together at a plurality of corners and dimensioned for mating engagement with said base frame such that at least one of said main panels extends the length of said base frame;

a plurality of reinforcement cleats aligned substantially parallel with the scores with at least one of the cleats adjacent each one of said corners and fixedly secured to one of said inner wall surfaces of said main panels;

a top frame dimensioned for receipt by said corrugated paperboard body;

a pair of spaced-apart, parallel attaching strips fixedly secured to each of at least two panels of said corrugated paperboard body, one of each said pair of attaching strips positioned on said respective panel for alignment with one of said pair of members, the other one of each said pair of attaching strips positioned on said respective panel for alignment with said top frame; and means for securing said attaching strips to said members and to said top frame;

whereby attachment of said corrugated paperboard body to said base frame and said top frame provides a connection that ensures against component separation.

2. The shipping container of claim 1, wherein said ones of each pair of attaching strips are positioned at lower edge portions of said respective panels of said corrugated paperboard body.

3. The shipping container of claim 1, wherein said other ones of said pairs of attaching strips are positioned at upper edge portions of said respective panels of said corrugated paperboard body.

4. The shipping container of claim 1, wherein said means for securing comprises staples inserted through both said corrugated paperboard body and said attaching strips into said respective members and said top frame.

5. The shipping container of claim 1, wherein said cleats are sufficiently distanced from said corners to permit collapsing of said corrugated paperboard body.

6. The shipping container of claim 1, wherein the top frame further comprises a sheet that extends the length and width thereof as a barrier to entry of dust into the container.

7. The shipping container of claim 1, wherein the attaching strips are disposed on respective outer surfaces of said container walls.

8. The shipping container of claim 1, wherein the attaching strips are disposed on respective inner surfaces of said container walls.

9. The shipping container of claim 1, wherein the attaching strips comprise elongate fibreboard strips.

10. The shipping container of claim 1, wherein the attaching strips are wood.

11. A wood-reinforced tubular corrugated paperboard shipping container, comprising:

a corrugated paperboard body comprising a wall-forming blank of paperboard scored to provide a first, a second, a third, and a fourth main panel defining interior container walls and exterior container walls, foldably joined together at corners, said panels each defining an upper portion and a lower portion;

a pair of vertical supports fixedly secured to the interior wall of said first main panel and said third main panel of said corrugated paperboard body, each of said pair of vertical supports having a top portion and a notched lower portion, said notched portion being one-half the width of the remaining portion of said vertical support;

a plurality of lower attaching strips secured about a lower portion of said corrugated paperboard body such that at least one of said attaching strips is secured to one of each of said first, said second, said third and said fourth main panels in substantial alignment with said notched lower portion of said vertical supports, said attaching strips being of a width substantially equal to that of said vertical supports at said notched portions;

a wooden rigid base member for mating connection with said corrugated paperboard body such that said base member is aligned with said lower attaching strips;

a top frame for mating engagement with said top portions of said vertical supports; and means for attaching said attaching strips to said respective base member and top frame, whereby attachment of said attaching strips of said corrugated paperboard body to said base member and said top frames provides a face-to-face connection ensuring against separation thereof.

12. The wood reinforced corrugated paperboard shipping container of claim 11, wherein said means for attaching comprises staples, each said staple inserted through said corrugated paperboard body and one of said attaching strips into said respective base member and top frame.

13. The wood-reinforced corrugated paperboard shipping container as recited in claim 11, wherein the top frame includes a sheet that extends the length and the width thereof for a barrier to dust.

14. A wood-reinforced tubular corrugated paperboard shipping container, comprising:

a base frame for supporting an article to be packed, said base frame including at least two wood strips that extend substantially the length of said base frame;

a tubular corrugated paperboard body defining inner container walls and corresponding outer container walls, said paperboard body comprising a wall forming blank of paperboard scored to provide a series of panels foldably joined together at a plurality of corners and configured for engagement to said base frame;

a plurality of substantially vertical, wooden supports fixedly secured to said inner container walls adjacent said corners and sufficiently distanced therefrom to permit collapse of said paperboard body;

a top frame for receipt by said tubular body and supporting contact with upper ends of said supports;

at least two pairs of spaced-apart attaching strips fixedly secured to a lowermost portion and an uppermost portion of said container walls, said attaching strips extending substantially a length of said container walls; and means for securing said attaching strips to said wood strips, and said attaching strips on said upper portions to said top frame, whereby said tubular corrugated paperboard body is secured to said base frame and said top frame to assure against component separation.

15. The wood reinforced corrugated paperboard shipping container of claim 14, wherein said means for securing comprises staples inserted through both said corrugated paperboard body and said attaching strips into said wood strips on top frame.

16. The wood reinforced corrugated paperboard shipping container of claim 14, wherein the top frame includes a sheet that extends the length and width thereof for a barrier to dust.

17. A reinforced tubular corrugated paperboard shipping container, comprising:

a base frame for supporting an article to be packed, said base frame including at least two elongate members;

a corrugated paperboard body comprising a wall forming blank of paperboard scored to provide a series of panels foldably joined together at a plurality of corners and configured for engagement to said base frame;

a plurality of substantially vertical supports fixedly secured to said container walls adjacent said corners for reinforcing said paperboard body;

at least two pairs of attaching strips, each pair fixedly secured to opposing ones of said panels, each of said pairs of attaching strips spaced-apart with one of each said pair of attaching strips positioned for alignment with one of said elongate members and the other one of each pair of attaching strips positioned for alignment with said top frame; and means for connecting said attaching strips to said elongate members and said top frame, whereby engagement of said reinforced corrugated paperboard body to said base frame and said top frame by connecting said attaching strips to said elongate members and said top frame ensures against component separation.

18. The reinforced tubular corrugated paperboard shipping container as recited in claim 17, wherein said attaching strips are wood.

19. The reinforced tubular corrugated paperboard shipping container as recited in claim 17, where said attaching strips are fiberboard.

20. The reinforced tubular corrugated paperboard shipping container as recited in claim 17, wherein said means for securing comprises a plurality of staples inserted through said panels of said corrugated paperboard body and said attaching strips into said elongate members and said top frame.

21. The reinforced tubular corrugated paperboard shipping container as recited in claim 17, wherein each said attaching strip is substantially equal in length to its associated said elongate member.

22. The reinforced tubular corrugated paperboard shipping container as recited in claim 17, wherein said attaching strips are fixedly secured to an inner surface of said panels.

23. The reinforced tubular corrugated paperboard shipping container as recited in claim 17, wherein said attaching strips are fixedly secured to an outer surface of said panels.

24. The reinforced tubular corrugated paperboard shipping container as recited in claim 17, wherein the top frame includes a sheet that extends the length and width thereof for a barrier to dust entry into the container.

* * * * *